United States Patent [19]

Nalesnik et al.

[11] Patent Number: 4,713,189

[45] Date of Patent: Dec. 15, 1987

[54] PRECOUPLED MONO-SUCCINIMIDE LUBRICATING OIL DISPERSANTS AND VITON SEAL ADDITIVES

[75] Inventors: Theodore E. Nalesnik, Beacon; Nicholas Benfaremo, Wappingers Falls, both of N.Y.

[73] Assignee: Texaco, Inc., White Plains, N.Y.

[21] Appl. No.: 898,275

[22] Filed: Aug. 20, 1986

[51] Int. Cl.[4] ..... C10M 133/16

[52] U.S. Cl. ..... 252/51.5 A; 252/51.5 R

[58] Field of Search ..... 252/51.5 A, 51.5 R

[56] References Cited

U.S. PATENT DOCUMENTS

| | | | |
|---|---|---|---|
| 4,354,950 | 10/1982 | Hammend et al. | 252/51.5 A |
| 4,482,464 | 11/1984 | Karol et al. | 252/51.5 A |
| 4,636,322 | 1/1987 | Nalesnik | 252/51.5 A |

*Primary Examiner*—William R. Dixon, Jr.
*Assistant Examiner*—Cynthia A. Prezlock
*Attorney, Agent, or Firm*—Robert A. Kulason; James J. O'Loughlin; Vincent A. Mallare

[57] ABSTRACT

A lubricating oil composition having improved dispersancy and viton seal compatibility. The dispersant being prepared by coupling two polyethyleneamines with an aldehyde and a phenol, followed by conversion to a succinimide. The resulting coupled succinimide is then acylated with glycolic acid to form a glycolated Mannich phenol coupled mono-alkenyl succinimide.

14 Claims, No Drawings

PRECOUPLED MONO-SUCCINIMIDE LUBRICATING OIL DISPERSANTS AND VITON SEAL ADDITIVES

BACKGROUND OF THE INVENTION

1. Field of the Invention

Internal combustion engines operate under a wide range of temperatures including low temperature stop-and-go service as well as high temperature conditions produced by continuous high speed driving. Stop-and-go driving, particularly during cold, damp weather conditions, leads to the formation of a sludge in the crankcase and in the oil passages of a gasoline or a diesel engine. This sludge seriously limits the ability of the crankcase oil to effectively lubricate the engine. In addition, the sludge with its entrapped water tends to contribute to rust formation in the engine. These problems tend to be aggravated by the manufacturer's lubrication service recommendations which specify extended oil drain intervals.

It is known to employ nitrogen containing dispersants and/or detergents in the formulation of crankcase lubricating oil compositions. Many of the known dispersant/detergent compounds are based on the reaction of an alkenylsuccinic acid or anhydride with an amine or polyamine to produce an alkylsuccinimide or an alkenylsuccinamic acid as determined by selected conditions of reaction.

It is also known to chlorinate alkenylsuccinic acid or anhydride prior to the reaction with an amine or polyamine in order to produce a reaction product in which a portion of the amine or polyamine is attached directly to the alkenyl radical of the alkenyl succinic acid or anhydride. The thrust of many of these processes is to produce a product having a relatively high level of nitrogen in order to provide improved dispersancy in a crankcase lubricating oil composition.

With the introduction of four cylinder internal combustion engines which must operate at relatively higher engine speeds or RPM's than conventional 6- and 8-cylinder engines in order to produce the required torque output, it has become increasingly difficult to provide a satisfactory dispersant lubricating oil composition.

Another problem facing the lubricant manufacturer is that of seal deterioration in the engine. All internal combustion engines use elastomer seals, such as Viton seals, in their assembly. Over time, these seals are susceptible to serious deterioration caused by the lubricating oil composition. A lubricating oil composition that degrades the elastomer seals in an engine is unacceptable to engine manufacturers and has limited value.

It is an object of this invention to provide a novel lubricating oil additive.

Another object is to provide a lubricating oil composition which can withstand the stresses imposed by modern internal combustion engines.

A still further object is to provide a novel lubricating oil composition which does not degrade elastomer seals in internal combustion engines.

2. Disclosure Statement

U.S. Pat. Nos., 3,172,892 and 4,048,080 disclose alkenylsuccinimides formed from the reaction of an alkenylsuccinic anhydride and an alkylene polyamine and their use as dispersants in a lubricating oil composition.

U.S. Pat. No. 2,568,876 discloses reaction products prepared by reacting a monocarboxylic acid with a polyalkylene polyamine followed by a reaction of the intermediate product with an alkenyl succinic acid anhydride.

U.S. Pat. No. 3,216,936 discloses a process for preparing an aliphatic amine lubricant additive which involves reacting an alkylene amine, a polymer substituted succinic acid and an aliphatic monocarboxylic acid.

U.S. Pat. No. 3,131,150 discloses lubricating oil compositions containing dispersant-detergent mono- and dialkyl-succinimides or bis(alkenylsucinimides).

Netherlands Pat. No. 7,509,289 discloses the reaction product of an alkenyl succinic anhydride and an aminoalcohol, namely a tris(hydroxymethyl) aminomethane.

U.S. patent application, Ser. No. 334,774, filed on Dec. 28, 1981, discloses a hydrocarbyl-substituted succinimide dispersant having a secondary hydroxy-substituted diamine or polyamine segment and a lubricating oil composition containing same.

U.S. Pat. No. 4,338,205 discloses alkenyl succinimide and borated alkenyl succinimide dispersants for a lubricating oil with impaired diesel dispersancy in which the dispersant is treated with an oil-soluble strong acid.

U.S. patent application, Ser. No. 795,023, filed on Nov. 4, 1985, discloses an additive which improves the dispersancy and viton seal compatibility of a lubricating oil. The additive is a reaction product of a polyethylene amine and an alkenyl succinic acid anyhdride.

The disclosures of U.S. Pat. Nos. 3,172,892, and 4,048,080 and of applications, Ser. Nos. 334,774 and 795,023, are incorporated herein by reference.

SUMMARY OF THE INVENTION

The present invention provides a novel additive which improves the dispersancy and viton seal compatibility of a lubricating oil. The lubricating oil composition comprises a major portion of a lubricating oil and a minor dispersant amount of a reaction product (i.e., lubricant additive) which may be prepared as set forth below.

PROCESS

A process for preparing a lubricating oil additive comprising:

(a) reacting a polyethyleamine with a phenolic compound in the presence of excess formaldehyde to give a Mannich coupled polyethyleneamine;

(b) reacting the Mannich coupled polyethyleneamine with an alkenyl succinic acid anhydride to form a Mannich coupled mono-alkenyl succinimide;

(c) acylating the coupled mono-alkenyl succinimide with glycolic acid to form a glycolated, Mannich coupled mono-alkenyl succinimide; and (d) recovering the glycolated, Mannich coupled mono-alkenyl succinimide.

DESCRIPTION OF THE INVENTION

The charge polyamine compositions which may be employed in practice of the process as of the present invention may include primary amines or secondary amines. The amines may typically be characterized by the formula

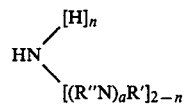

In this formula, a may be an integer of about 1 to about 6, preferably about 5; and may be 0 or 1.

In the above compound, R′ may be hydrogen or a hydrocarbon group selected from the group consisting of alkyl, aralkyl, cycloalkyl, aryl, alkaryl, alkenyl, and alkynyl including such radicals when inertly substituted. When R′ is alkyl, it may typically be methyl, ethyl, n-propyl, iso-propyl, n-butyl, i-butyl, sec-butyl, amyl, octyl, decyl, octadecyl, etc. When R′ is aralkyl, it may typically be benzyl, beta-phenylethyl, etc. When R′ is cycloalkyl, it may typically be cyclohexyl, cycloheptyl, cyclooctyl, 2-methylcyclo-heptyl, 3-butylcyclohexyl, 3-methylcyclohexyl, etc. When R′ is aryl, it may typically be phenyl, naphthyl, etc. When R′ is alkaryl, it may typically be tolyl, xylyl, etc. When R′ is alkenyl, it may typically be allyl, 1-butenyl, etc. When R′ is alkynyl, it may typically be ethynyl, propynyl,butynyl, etc. R′ may be inertly substituted i.e. it may bear a non-reactive substituent such as alkyl, aryl, cycloalkyl, ether, halogen, nitro, etc. Typically inertly substituted R′ groups may include 3-chloropropyl, 2-ethoxyethyl, carboethoxymethyl, 4-methyl, cyclohexyl, p-chlorophenyl, p-chlorobenzyl, 3-chloro-5-methylphenyl, etc. The preferred R groups may be hydrogen or lower alkyl, i.e. $C_1$–$C_{10}$ alkyl, groups including e.g. methyl, ethyl, n-propyl, i-propyl, butyls, amyls, hexyls, octyls, decyls, etc. R′ may preferably be hydrogen.

R″ may be a hydrocarbon selected from the same group as R′ subject to the fact that R″ is divalent and contains one less hydrogen. Preferably R′ is hydrogen and R″ is $—CH_2CH_2—$. Typical amines which may be employed may include those listed below in Table I.

TABLE I ethylenediamine (EDA)
propylenediamine (PDA)
diethylenetriamine (DETA)
triethylenetetriamine (TETA)
tetraethylenepentamine (TEPA)
pentaethylenehexamine (PEHA)

The preferred amine may be tetraethylenepentamine.

The charge aldehyde which may be employed may include those preferably characterized by the formula $R^2CHO$.

In the above compound, $R^2$ may be hydrogen or a hydrocarbon group selected from the group consisting of alkyl, aralkyl, cycloalkyl, aryl, alkaryl, alkenyl, alkynyl, and acyl including such radicals when inertly substituted. When $R^2$ is alkyl, it may typically be methyl, ethyl, n-propyl, iso-propyl, n-butyl, i-butyl, sec-butyl, amyl, octyl, decyl, octadecyl, etc. When $R^2$ is aralkyl, it may typically be benzyl, beta-phenylethyl, etc. When $R^2$ is cycloalkyl, it may typically be cyclohexyl, cycloheptyl, cyclooctyl 2-methylcyclo-heptyl, 3-butylcyclohexyl, 3-methylcyclohexyl, etc. When $R^2$ is aryl, it may typically be phenyl, naphthyl, etc. When $R^2$ is alkaryl, it may typically be tolyl, xylyl, etc. When $R^2$ is alkenyl, it may typically be vinyl, allyl, 1-butenyl, etc. When $R^2$ is alkynyl, it may typically be ethynyl, propynyl, butynyl, etc. $R^2$ may inertly substituted i.e. it may bear a non-reactive substituent such as alkyl, aryl, cycloalkyl, ether, halogen, nitro, etc. When $R^2$ is acyl, it may typically be acetyl or benzoyl. Typically inertly substituted R groups may include 3-chloropropyl, 2-ethoxyethyl, carboethyoxymethyl, 4-methyl cyclohexyl, p-chlorophenyl, p-chlorbenzyl, 3-chloro-5-methylphenyl, etc. The preferred $R^2$ groups may be lower alkyl, i.e., $C_1$–$C_{10}$ alkyl groups, including, e.g., methyl, ethyl, n-propyl, i-propyl, butyls, amyls, hexyls, octyls, decyls, etc. $R^2$ may preferably be hydrogen.

Typical aldehydes which may be employed may include those listed below in Table II.

TABLE II formaldehyde
ethanal
propanal
butanal etc.

The preferred aldehyde may be formaldehyde employed as its polymer-paraformaldehyde.

The charge phenols which may be employed in practice of the process of this invention may preferably be characterized by the formula $HR^3OH$. It is a feature of these phenols that they contain an active hydrogen which will be the site for substitution. Poly-phenols (e.g. compounds containing more than one hydroxy group in the molecule whether on the same ring or not) may be employed. The rings on which the hydroxy groups are sited may bear inert substituents. However, at least two positions, e.g., ortho- and para-, to a phenol hydroxy group, must be occupied by an active hydrogen as this is the point of reaction with the imine group.

$R^3$ may be an arylene group typified by $—C_6H_4—$, $—C_6H_3(CH_3)—$, or $—C_6H_3(C_2H_5)—$.

Typical phenols which may be employed may include those listed below in Table III.

TABLE III

Phenol
Bisphenol A
Resorcinol
Mono-nonyl phenol
Beta-naphthol

The preferred phenols may be phenol or mono-nonyl phenol.

In practice of the process of this invention, the reagents are step wise reacted with a succinic acid anhydride bearing a polyolefin substituent containing residual unsaturation in a "one pot reaction".

The succinic acid anhydride may be characterized by the following formula

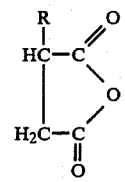

In the above formula, R may be a residue (containing residual unsaturation) from a polyolefin which was reacted with maleic acid anhydride to form the alkenyl succinic acid anhydride. R may have a molecular weight $\overline{M}_n$ ranging from about 500 to about 4000, preferably about 1000 to about 2100, and more preferably about 2100.

The Mannich phenol coupled glycamide mono-alkenyl succinimide may be prepared by the process set forth below.

Process (Scheme I)

The first step of the reaction sequence involves reacting a polyethyleneamine, with enough of an aldehyde, to form the imine (A). To this intermediate (A) is added one-half of an equivalent of a phenolic compound, or any other compound capable of reacting with a two imines, to give the coupled polyethyleneamine (B). The intermediate (B) is then reacted, with enough of an alkenyl succinic acid anhydride (ASAA) to ensure complete imidization and give the coupled alkenyl succinimide (C). To this intermediate (C) is added enough glycolic acid to acylate most of the free basic amines remaining to form the glycolated, coupled, monosuccinimide (D).

The preferred acylating agents which are carboxylic acids may be glycolic acid; oxalic acid; lactic acid; acetic acid; 2-hydroxymethyl propionic acid, or 2,2-bis(hydroxymethyl) propionic acid. The most preferred being glycolic acid.

Acylation may be effected preferably by addition of the acylating agent (e.g., glycolic acid or oxalic acid) to the reaction product of the coupled polyethyleneamine and the succinic acid anhydride.

Acylation is preferably effected by adding the acylating agent (typically oxalic acid or glycolic acid) in an amount of about 0.5 to about 3.0 equivalents per mole of active amine employed.

For example, when tetraethylenepentamine (TEPA) is employed, there are about 2.0 equivalents of glycolic

SCHEME I

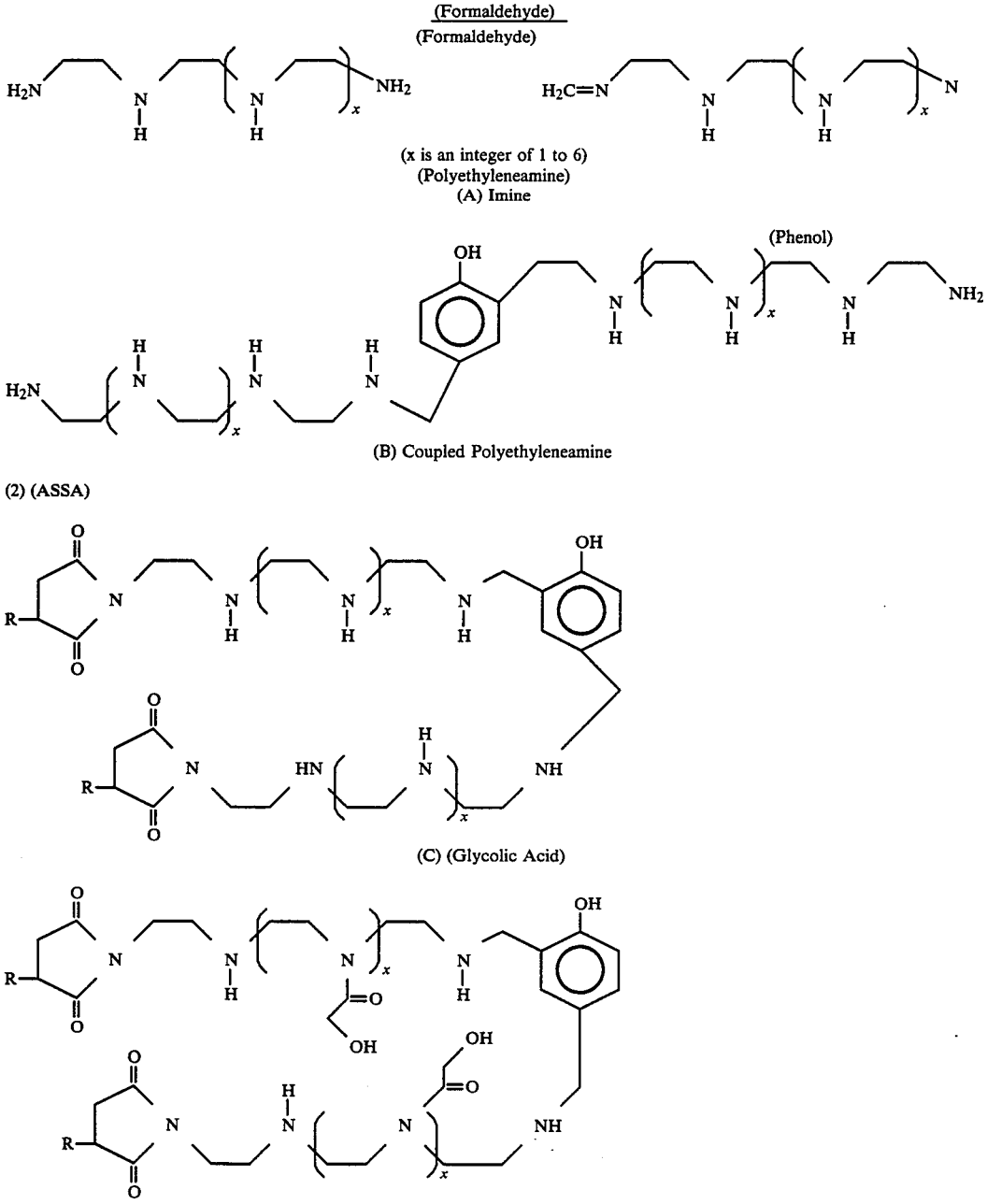

acid added. Similarly, when triethylenetetramine (TETA) is used, about 0.84 equivalent of glycolic acid is added; and when pentaethylenehexamine (PEHA) is employed, about 3.2 equivalents of glycolic acid are added to the reaction.

During acylation, the carboxyl group of the acylating agent bonds to a nitrogen atom to form an amide. Acylation is carried out at about 100° C. to about 180° C., say 160° C. for about 2 to about 24 hours, say 8 hours, preferably in the presence of an excess of inert diluent-solvent.

The acylated product may in one of its embodiments be represented by the formula

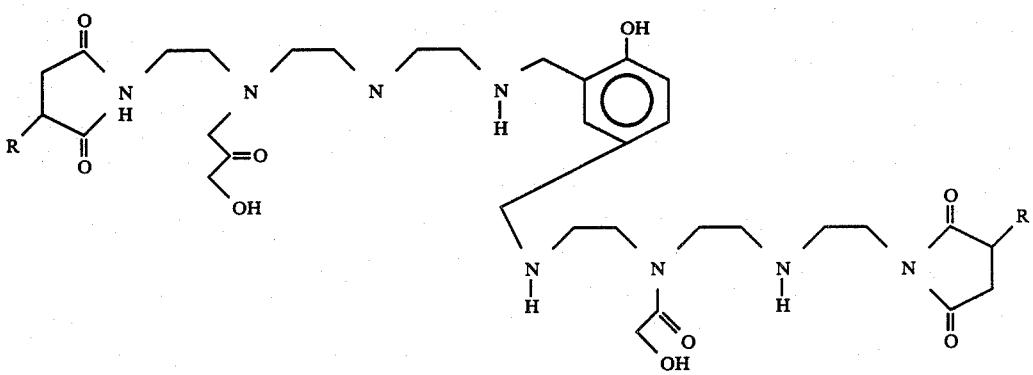

where R is polyisobutenyl.

In order to illustrate the effectiveness of the present compounds, i.e., coupled glycolated succinimides, as dispersants with viton seal compatibilty, there are several tests to which the present succinimides have been subjected. These tests include the Caterpillar 1-G2 Engine Test, and the Daimler-Benz Viton Compatability Test. These tests are described below in more detail as well as the results of the various tests are provided below in Tables IV, V and VI.

THE BENCH VC TEST (BVCT)

This test is conducted by heating the test oil mixed with a synthetic hydrocarbon blowby and a diluent oil at a fixed temperature for a fixed time period. After heating, the trubidity of the resulting mixture is measured. A low percentage trubidity (0 to 10) is indicative of good dispersancy while a high value (20 to 100) is indicative of an oil's increasingly poor dispersancy. The results obtained with the known and present dispersants are set forth in Table II below at 6 and 4 percent by weight concentration respectively, in an SAE 10W-40 fully formulated motor oil.

THE BENCH V-D TEST (BVDT)

In the Bench V-D Test, (BVDT), oil samples are artificially degraded by ubbling air for six hours through a mixture of test oil and synthetic blowby at 290° F. Every hour, synthetic blowby is added and at the 5th and 6th hour of the test, samples are removed and diluted with SNO-7/20 diluent oil and their turbidity measured. Low turbidity in the BVDT indicates good lubricant dispersancy as related to the Sequench V-D Test.

SEQUENCE V-D TEST

Various dispersants including known dispersants and the present dispersants were tested by the Sequence V-D gasoline engine test in a fully formulated motor oil at about 5.4 wt. % and gave the results shown below in Table IV.

The Sequence V-D test evaluates the performance of engine oils in terms of the protection provided against sludge and varnish deposits as well as valve train wear. The test was carried out with a Ford 2.3 liter 4 cylinder gasoline engine using cyclic low and mid range engine operating temperatures and a high rate of blowby.

TABLE IV

SEQUENCH V-D ENGINE TESTING[1]

| Material | Description | | | | |
|---|---|---|---|---|---|
| I | H-1500 ASAA, TEPA, Uncoupled | 5.45 | — | — | — |
| II | H-1500 ASAA, TEPA, n-phenol, precoupled | — | 5.45 | — | — |
| III | H-1500 ASAA, TETA, n-phenol, precoupled | — | — | 5.45 | — |
| IV | H-300 ASAA, TETA, n-phenol | — | — | — | 5.45 |
| | Average Sludge | 9.6 | 9.5 | 9.5 | 9.6 |
| | Average Varnish | 6.7 | 6.6 | 7.0 | 6.6 |
| | Piston Skirt Varnish | 7.2 | 6.9 | 7.0 | 6.8 |
| | Cam Lobe Wear Max, Mils | 60.4 | 0.4 | 0.4 | 0.3 |
| | Cam Lobe Wear Ave, Mils | 0.29 | 0.29 | 0.27 | 0.18 |

[1]These dispersant were glycolated and evaluated in a SArade SF/CD motor oil formulation.
TETA — Triethylenetetramine
TEPA — Tetraethylenepentamine
PEHA — Pentaethylenehexamine
ASAA — Alkenyl succinic acid anhydride; H-1500 ASAA (m); n-phenol = 4-nonylphenol; H-300 ASAA (mw≈1300)

THE CATERPILLER 1-G2 TEST

The diesel engine performance of Example II, which was measured by the Caterpiller 1-G2 testing in a SAE 30 fully formulated oil formulation using 5.45 wt. % of the dispersant, gave the results shown below in Table V.

TABLE V

CATERPILLAR 1-G2 ENGINE TESTING[1]

| Material | Description | TGF, % | WTD |
|---|---|---|---|
| I | H-1500 ASAA, TEPA, uncoupled | 86 | 383 |
| II | H-1500 ASAA, TEPA, n-phenol, pre-coupled | 84 | 297 |
| III | H-1500 ASAA, TETA, n-phenol pre-coupled | 77 | 295 |

[1]Dispersants evaluated at 5.45 wt. % in a prototype SAE 30 SF/CD motor oil formulation.
TGF—Top grove fill.
WTD—Weighted total demerits.

THE DAIMLER - BENZ VITON COMPATIBILITY TEST

An important property of a lubricating oil additive and a blended lubricating oil composition containing additives is the compatibility of the oil composition with the rubber seals employed in the engine. Nitrogen containing succinimide dispersants employed in crankcase lubricating oil compositions have the effect of seriously degrading the rubber seals in internal combustion engines. In particular, such dispersants are known to attack Viton AK-6 rubber seals which are commonly employed in internal combustion engines. This deterioration exhibits itself by sharply degrading the flexibility of the seals and in increasing their hardness. This is such a critical problem that the Daimler-Benz Corporation requires that all crankcase lubricating oils must pass a Viton Seal Compatibility Test before the oil composition will be rated acceptable for engine crankcase service. The AK-6 Bend Test is described below and is designed to test the Viton seal compatibility for a crankcase lubricating oil composition containing a nitrogen-containing dispersant.

This test method is based on the Daimler-Benz VDA 251-01 Fluorohydrocarbon Seal Compatibility Test; ASTM D 412 Standard Test, Rubber Properties in Tension; ASTM D 471 Standard Test Method for Rubber Property, Effect of Liquids; and ASTM D 2240 Standard Test Method for Rubber Property, Durometer Hardness.

The Viton Seal Compatibility Test is conducted by soaking a sample of Viton AK-6 rubber at an elevated temperature in the oil being tested and then testing the rubber sample for volume change, elongation change, hardness change and tensile strength.

The specific procedure involves cutting three 25.4 mm by 50.8 mm specimens for each test oil from a sheet of elastomer. A small hole is punched in one end of each specimen. Each specimen is weighed in air and in water to the nearest mg. After weighing in water, each specimen is dipped in alcohol and let dry on clean filter paper. The hardness of the specimens is determined with a durometer. The three specimens are stacked on the top of each other and five hardness measurements made at least 6.4 mm apart. The average of the five measurements is the hardness value.

The three specimens are suspended in a graduated cylinder by inserting a piece of nichrome wire through the small hole in the end of each specimen. The specimens are arranged so that they do not touch each other or the sides of the cylinder. 200 ml of test oil are poured into the cylinder. The cylinder opening is sealed with an aluminum foil covered cork. The cylinder is aged for 168 hours in an oven maintained at 150° C.±1° C.

Six dumbell specimens are cut from a sheet of elastomer and the elongation and tensile strength of three of the specimens measured.

The remaining three specimens are suspended in a graduated cylinder by inserting a piece of nichrome wire through a small hole punched in one end of each specimen. 200 ml of test oil are poured into the cylinder. The cylinder is stoppered with an aluminum foil covered cork and aged for 168 hours in an oven maintained at 150° C.±1° C.

At the end of the test period, the cylinders are removed from the oven and the specimens transferred to fresh portions of the test fluid and let cool for 30-60 minutes. The specimens are removed from the cylinder, rinsed with ethyl ether and air dried. Elongation and tensile strength measurements are made on each dumbell specimen. Each rectangular specimen is weighed in air and in water and measured for hardness.

The results of the Daimler-Benz test runs are provided below in Table VI.

TABLE VI

DAIMLER-BENZ VITON COMPATIBILITY TESTING[1]

| Dispersant | Cracking | % Elongation | % Tensil Strength |
|---|---|---|---|
| I | None | −38 | −45.9 |
| II | None | −38 | −49.0 |
| III | None | −25 | −36 |

[1]Dispersants evaluated at 0.05% N in a prototype SAE30 SF/CD

We claim:

1. A lubricating oil composition comprising a major portion of a lubricating oil and a minor dispersant amount of a reaction product prepared by a process which comprises:
   (a) reacting a polyethyleneamine with a phenolic compound in the presence of excess formaldehyde to form a Mannich phenol coupled polyethyleneamine;
   (b) reacting said Mannich phenol coupled polyethyleneamine with an alkenyl succinic acid anhydride to form a Mannich phenol coupled mono-alkenyl succinimide;
   (c) acylating said coupled mono-alkenyl succinide with glycolic acid to form a glycolated Mannich phenol coupled mono-alkenyl succinimide; and
   (d) recovering said glycolated Mannich phenol coupled mono-alkenyl succinimide.

2. The lubricating oil composition of claim 1, wherein said polyethylene amine is represented by the formula

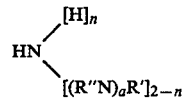

where R′ is H or a hydrocabon selected from the group consisting of alkyl, alkalyl, cycloalkyl, aryl, alkaryl, alkenyl and alkynyl group; R″ is a hydrocarbon selected from the same group as R′ except that R″ contains one less H; a is an integer of about 1 to about 6; and n is 0 or 1.

3. The lubricating oil composition of claim 1, wherein said amine is selected from the group consisting of ethylenediamine, propylenediamine, diethylenetriamine, triethylenetetramine, tetraethylenepentamine and pentaethylenehexamine.

4. The lubricating oil composition of claim 1, wherein said amine is tetraethylenepentamine.

5. The lubricating oil composition of claim 1, wherein said amine is pentaethylenehexamine.

6. The lubricating oil composition of claim 1, wherein said amine is triethylenetetramine.

7. The lubricating oil composition of claim 1, wherein oxalic acid is substituted for glycolic acid.

8. The lubricating oil composition of claim 1, wherein said acid aldehyde is selected from the group consisting of formaldehyde, paraformaldehyde, ethanal, propanal and butanal.

9. The lubricating oil composition of claim 8, wherein said aldehyde is paraformaldehyde.

10. The lubricating oil composition of claim 1, wherein said phenol is selected from the group consisting of phenol, bisphenol A, resorcinol, and beta-naphthol.

11. The lubricating oil composition of claim 1, wherein said phenol is phenol.

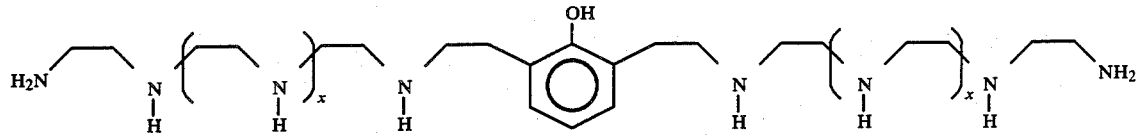

12. The lubricating oil composition of claim 11, wherein said phenol is 4-nonylphenol.

13. The lubricating oil composition of claim 1, wherein said reaction product is an acylated Mannich phenol coupled glycamide mono-alkenyl succinimide (a) reacting a polyethyleneamine with a phenolic compound in the presence of excess formaldehyde to form a Mannich phenol coupled polyethyleneamine wherein x is an integer of from 1 to 6;

(b) reacting said Mannich phenol coupled polyethyleneamine with enough alkenyl succinic acid anhydride (ASAA) to ensure complete imidization and give the Mannich coupled alkenyl succinimide

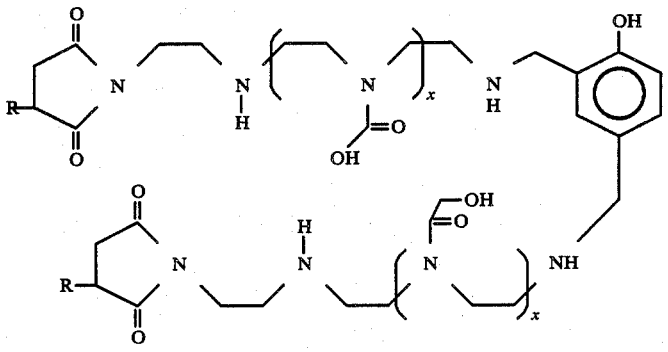

where R is polyisobutenyl and x is an integer of 1 to 6.

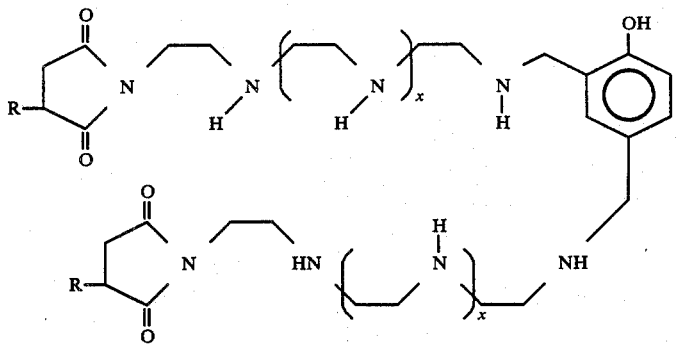

14. A lubricating oil composition comprising a major portion of a lubricating oil and minor dispersant amount of a reaction product prepared by a process which comprises:

wherein R is polyisobutenyl (c) acylating said mono-alkenyl succinimide with glycolic acid to form a glycolated Mannich phenol coupled mono-alkenyl succinimide

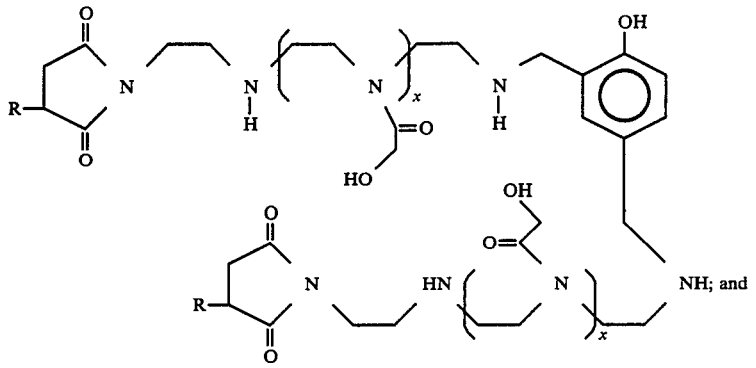
and
(d) recovering said glycolated Mannich phenol coupled mono-alkenyl succinimide.
* * * * *